US005954273A

United States Patent [19]

Ruta et al.

[11] Patent Number: 5,954,273

[45] Date of Patent: Sep. 21, 1999

[54] SPRAY ASSEMBLY FOR HIGH VISCOSITY MATERIALS

[75] Inventors: Constantin I. Ruta, White Bear Lake; Alan G. McKown, Oakdale; Russell E. Blette, Hastings; Robert M. Petrie, Plymouth, all of Minn.

[73] Assignee: Minnesota Mining and Manufacturing Company, St. Paul, Minn.

[21] Appl. No.: 08/841,428

[22] Filed: Apr. 22, 1997

[51] Int. Cl.[6] ..... B05B 7/08

[52] U.S. Cl. ..... 239/419.3; 239/307; 239/354; 239/369; 239/433; 137/893; 251/209

[58] Field of Search ..... 239/61, 304, 306, 239/307, 340, 354, 369, 407, 419, 422, 426, 428, 433, 419.3; 137/893; 251/209

[56] References Cited

U.S. PATENT DOCUMENTS

| | | | |
|---|---|---|---|
| 1,997,874 | 4/1935 | Power | 239/428 X |
| 2,265,209 | 12/1941 | Thompson | 239/428 X |
| 2,310,633 | 2/1943 | Heimburger | 239/369 X |
| 2,510,514 | 6/1950 | Mueller | 251/209 |
| 2,513,081 | 6/1950 | Clark et al. | 239/428 X |
| 2,813,751 | 11/1957 | Barrett | 239/306 |
| 3,178,118 | 4/1965 | New | 239/422 |
| 3,179,341 | 4/1965 | Plos et al. | 239/428 X |
| 3,246,850 | 4/1966 | Bourke | 239/394 |
| 3,632,046 | 1/1972 | Hengesbach | 239/354 X |
| 3,773,291 | 11/1973 | Grauer | 251/209 X |
| 3,907,205 | 9/1975 | Shreve | 239/307 |
| 3,986,668 | 10/1976 | Huhne et al. | 239/85 |
| 4,020,990 | 5/1977 | Luff | 239/346 |
| 4,781,329 | 11/1988 | Tenney et al. | 239/305 |
| 5,005,736 | 4/1991 | Portas | 222/135 |
| 5,236,128 | 8/1993 | Morita et al. | 239/407 |
| 5,524,863 | 6/1996 | Davis | 251/209 X |
| 5,551,467 | 9/1996 | Booth et al. | 251/209 X |
| 5,667,142 | 9/1997 | Newman | 239/354 X |
| 5,713,519 | 2/1998 | Sandison et al. | 239/443 X |

FOREIGN PATENT DOCUMENTS

| | | | |
|---|---|---|---|
| 0371634 A2 | 6/1990 | European Pat. Off. | B05B 7/24 |
| 3336053 A1 | 4/1985 | Germany | B05B 7/08 |
| WO 93/08929 A1 | 5/1993 | WIPO | B05D 5/06 |
| WO 97/03758 | 2/1997 | WIPO | B05B 7/24 |

OTHER PUBLICATIONS

International Search Report—PCT/US97/14739.

U.S. Patent application Serial No. 08/505,088, filed Jul. 21, 1995.

*Primary Examiner*—Andres Kashnikow
*Assistant Examiner*—Steven J. Ganey
*Attorney, Agent, or Firm*—William L. Huebsch

[57] ABSTRACT

A spray assembly for mixing catalyst with a high viscosity material and applying thin coatings of that material to a substrate that is particularly useful for applying body putty to a surface. The spray assembly has first and second through air passageways between an inlet end portion and different portions of an outlet end. The through air passageways each have a straight central axis adjacent the outlet end, the extensions of which axes outside the spray nozzle intersect a short distance from the outlet end of the spray nozzle. A large suction tube for the larger first air passageway has an upper end positioned within a cylindrical portion of the first air passageway. Air streams propelled through the passageways draw high viscosity material through the larger suction tube and catalyst through a smaller suction tube into those air streams. Intersection of those air streams outside of the nozzle mixes the catalyst material with the high viscosity material. A manually operable valve in the larger suction tube can adjust the amount of catalyzed high viscosity material being sprayed.

20 Claims, 5 Drawing Sheets

SPRAY ASSEMBLY FOR HIGH VISCOSITY MATERIALS

TECHNICAL FIELD

The present invention relates to assemblies used to spray coatings of materials onto substrates and in one aspect to methods for applying body putty onto surfaces.

BACKGROUND

Repair of small scratches or pits on the painted surface of on an automobile or similar vehicle has typically required filling the scratch or pit with body putty, allowing that body putty to harden and adhere to the surface of the vehicle, and then sanding away the excess putty around and over the scratch or pit to provide a smooth outer surface that can be painted to match the rest of the paint on the vehicle. Typically, such body putty is applied by pressing it onto the surface of the vehicle with a putty knife or similar implement. Significantly more body putty is applied than is needed to insure that there will be no voids in the portion of the body putty that will remain on the vehicle after sanding.

DISCLOSURE OF INVENTION

The present invention provides an easy to clean spray assembly that can mix catalyst with a high viscosity material and apply thin coatings of that mixed material to a substrate, and is particularly useful for applying thin pin hole free coatings of two part body putty to a surface during the repair of small scratches or pits in the paint of an automobile or similar vehicle.

The spray assembly according to the present invention includes a spray nozzle having an inlet end portion adapted to be coupled to a source of air under pressure, and an outlet end. The spray nozzle has first and second through air passageway between its inlet end portion and different portions of its outlet end, which through air passageways each have a straight central axis adjacent the outlet end, the extensions of which axes outside the spray nozzle intersect a short distance from the outlet end of the spray nozzle. For each air passageway there is a suction tube. The larger suction tube for the larger first air passageway has an upper end positioned within the portion of first air passageway having the straight central axis. The smaller suction tube for the smaller second air passageway has an upper end positioned with a portion of its suction passageway at its upper end disposed at generally a right angle with respect to the central axis of the second passageway. Air streams propelled through the passageways from the inlet end portion will pass over the upper ends of the suction tubes, and will cause vacuums that will draw high viscosity material through the larger suction tube and catalyst through the smaller suction tube into those air streams. Those air streams then intersect at the position spaced from the outlet end of the nozzle to mix the catalyst material with the high viscosity material outside of the spray nozzle. A manually operable valve in the larger suction tube can adjust the amount of catalyzed high viscosity material being sprayed by the spray assembly. When the inlet end of the spray nozzle is attached to and supported on a hand held air gun attached by a hose to a source of air under pressure it can be used, for example, to spray mixed two part body putty onto a damaged surface of an automobile. The amount of body putty being coated can be adjusted by the valve to change the ratio between the amount of air and the amount of body putty being dispensed. The amount of catalyst being dispensed remains constant, however, the higher than needed ratio of catalyst in the body putty when the amount of body putty is reduced does not adversely effect the body putty and only accelerates its rate of cure. By reducing the amount of body putty being dispensed a spray pattern only about 2 inch or 5 centimeters wide and 0.002 inch or 0.005 centimeter thick of pinhole free body putty can be applied, which pattern can cover a small scratch or small pit, and requires only a small amount of sanding to remove the excess body putty around and over that scratch or pit.

Very uniform application of body putty having a viscosity of about 5000 centipoise is possible when the inner surface defining the first through air passageway is generally cylindrical and has a generally uniform diametrical dimension (e.g., 0.345 inch or 0.876 cm) for the majority of the distance from the upper end of the first suction tube to the outlet end of the nozzle, and the through opening in the first suction tube has a cross sectional area (e.g., 0.049 square inch or 0.317 square centimeters) that is over 50 percent (e.g., about 52.5 percent) of the cross sectional area (e.g., 0.094 square inch or 0.60 square centimeters) of the generally cylindrical portion of the first through passageway.

The spray assembly can be used to spray materials having viscosities in excess of 8000 centipoise.

Also, the valve and spray nozzle are easily purged of the un-catalyzed high viscosity material after use. When closed, the valve allows air to be drawn through the valve and into the portion of the suction tube between the valve and the air passageway to expel the high viscosity material from the valve, that portion of the suction tube, and the spray nozzle.

The axes of the straight central portions of the air passageways adjacent their outlet end should preferably be disposed at an included angle in the range of about 30 to 45 degrees. If this angle is much greater, the catalyst can undesirable deflect or deform the cone of viscous material being sprayed from the first through air passageway. If this angle is much less the catalyst may not become thoroughly mixed in the cone of viscous material being sprayed from the first through air passageway.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
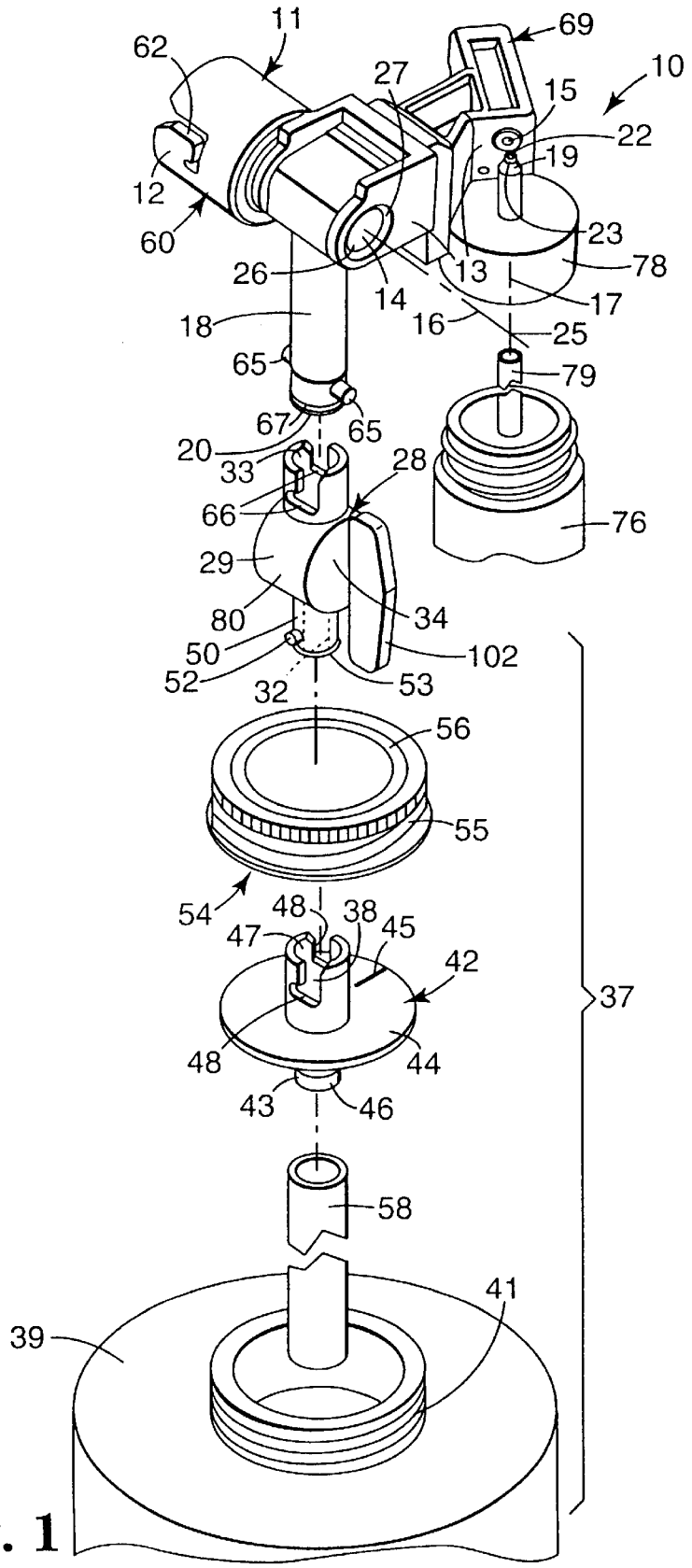
FIG. 1 is an exploded perspective view of a spray assembly according to the present invention shown with containers for materials that can be mixed and sprayed to which the spray assembly may be attached.

Referring now to FIG. 1 of the drawing, there is shown a spray assembly according to the present invention generally designated by the reference numeral 10.

Figure 6:
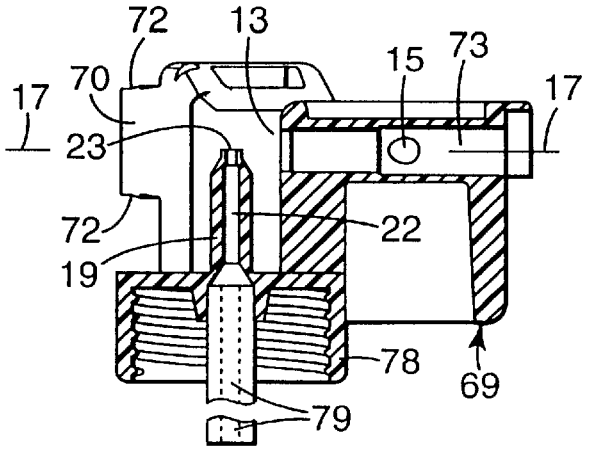
FIG. 6 is a sectional view taken approximately along line 6—6 of FIG. 3.
Figure 7:
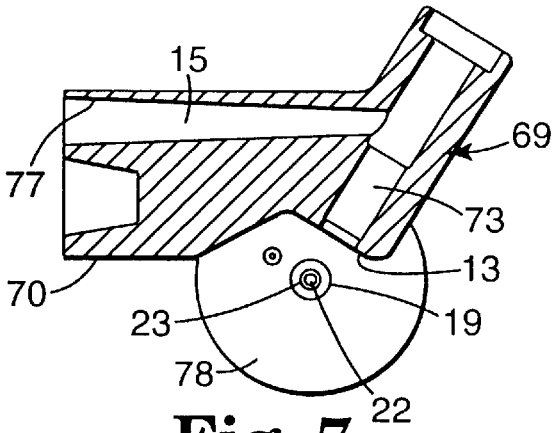
FIG. 7 is a sectional view taken approximately along line 7—7 of FIG. 3.
Figure 5:
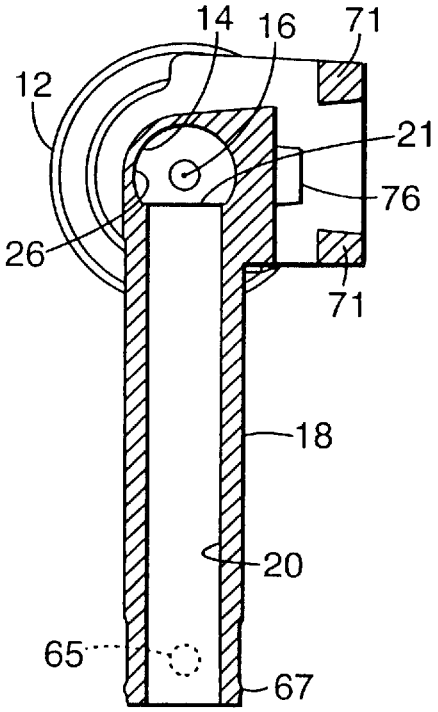
FIG. 5 is a sectional view taken approximately along line 5—5 of FIG. 3.
Figure 8:
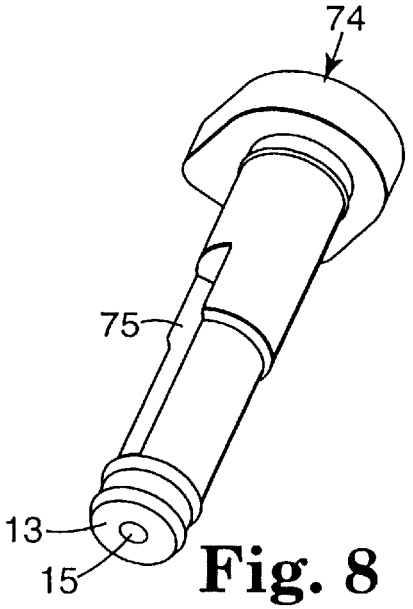
FIG. 8 is a different perspective view of a portion of the spray nozzle illustrated in FIG. 3.

Generally the spray assembly 10 comprises a spray nozzle 11 having an inlet end portion 12 adapted to be coupled to a source of air under pressure, an outlet end 13, and first and second through air passageways 14 and 15 between its inlet end portion 12 and different portions of its outlet end 13. The through air passageways 14 and 15 each have straight central axes 16 and 17 adjacent the outlet end 13, the extensions of which axes 16 and 17 outside the nozzle 11 intersect at a position 25 a short distance from the outlet end 13 of the nozzle 11 (e.g., intersect at an angle of about 31.5 degrees about 2.1 inches or 5.3 centimeters from the outlet end of the nozzle 11). For each air passageway 14 and 15 there is a suction tube 18 and 19 respectively. The larger suction tube 18 for the larger first air passageway 14 is adapted to draw high viscosity material through a suction passageway 20 in it. The suction tube 18 (which is the larger of the two suction tubes 18 and 19) has an upper end 21 (see FIG. 5) positioned within the first air passageway 14 with a portion of its suction passageway 20 at its upper end disposed at generally a right angle with respect to the straight central axis 16 of the first through air passageway 14 it intersects. The smaller suction tube 19 for the smaller second air passageway 15 is adapted to draw a relatively low viscosity catalyst for the high viscosity material through a suction passageway 22 in it (see FIG. 6) and has an upper end 23 positioned with a portion of its suction passageway 22 at its upper end disposed at generally a right angle with respect to the central axis 17 of the second passageway 14 at a position spaced from the outlet end 13 of the nozzle 11. Air streams propelled through the passageways 14 and 15 from the inlet end portion will pass over the upper ends 21 and 23 of the suction tubes 18 and 19 and draw the materials indicated above through the suction tubes 18 and 19 into those air streams, and will then intersect at the position 25 spaced from the nozzle 11 to mix the catalyst material with the high viscosity material outside of the spray nozzle 11 just before those materials strike a surface onto which they are being sprayed.

Preferably for spraying high viscosity materials (e.g., body putty having a viscosity of about 5200 centipoise) an inner surface of the spray nozzle 11 that defines the first through air passageway 14 includes a generally cylindrical uniform diameter portion 26 (e.g., 0.345 inch or 0.876 centimeter diameter) extending for the majority of the distance from the side of the suction tube 18 opposite the outlet end 13 of the spray nozzle 11 to closely adjacent the outlet end 13 of the spray nozzle 13 (e.g., 0.409 inch or 1.04 centimeter axial length) and has a very smooth finish (e.g., SPE/SPI No. 1 finish). This portion of the air passageway 14 shapes the exit cone of the material being sprayed. Between the cylindrical inner surface portion 26 and the outlet end 13 of the Nozzle 11 is a short (e.g., 0.047 inch or 0.12 centimeter axial length) diverging frusta-conical inner surface 27 which restricts disturbances of the air stream at its periphery that would occur from a sharp and/or jagged edge at the intersection between the cylindrical inner surface portion 26 and the surface at the outlet end 13. Instead of the frusta-conical inner surface 27, a radiused surface could be used at the intersection between the cylindrical inner surface portion 26 and the surface at the outlet end 13. For use in spraying body putty, the through opening 20 in the first suction tube 18 (e.g., 0.25 inch or 0.635 centimeter diameter) can have a cross sectional area (e.g., of 0.049 square inch or 0.317 square centimeter) that is over 50 percent (e.g., about 52.5 percent) of the cross sectional area (e.g., 0.094 square inch or 0.60 square centimeter) of the cylindrical inner surface portion 26 of the first through passageway 14, the distance from the center of the upper end of the first suction tube 18 and its suction passageway 20 to the outlet end 13 is in the range of about 0.4 to 0.5 inch or 1 to 1.27 centimeters and preferably about 0.41 inch or 1.04 centimeters, and the distance from the upper end of the first suction tube 18 to the center of the cylindrical inner surface portion 26 or straight central axis 16 thereof is in the range of about 0.08 to 0.12 inch or 0.2 to 0.3 cm and preferably about 0.1 inch or 0.254 cm so that the first suction tube 18 projects between about 15 to 27 percent (and preferably 19 percent) of the distance across the diameter of the cylindrical inner surface portion 26. This preferred distance from the upper end of the first suction tube 18 to the center of the cylindrical inner surface portion 26 or straight central axis 16 thereof was determined by moving the upper end of the suction tube 18 to vary this distance until the best performance of the spray nozzle 11 spraying body putty was obtained (i.e., the suction tube was separate from and was threaded into the portion of the nozzle 11 forming the first through passageway. This could be done in the nozzle 11 if it was desired to provide finer adjustments for spraying various viscous materials). The portion of the first air passage 14 from the end portion 12 adapted to be coupled to a source of air under pressure to the cylindrical inner surface portion 26 has a significantly smaller cylindrical diameter (e.g., about 0.1 inch or 0.254 centimeter) than the cylindrical inner surface portion 26. The air passageway configuration described above has been found to provide atomization of particles of the high viscosity materials that is more uniform than that which can be achieved with a venturi type air nozzle. For example, with the 5200 centipoise non-Newtonian body putty material commercially available as "Sprayable Polyester Film, Part No. 051131-05825" from Minnesota Mining and Manufacturing Company, St. Paul, Minn., such a nozzle with input air pressure of 40 pounds per square inch or 2.81 kilograms per square centimeter has been found to cause atomization in the size range of about 40 to 70 microns. Such atomization occurs by creating a suction that draws the material through the suction tube 18 into the air passageway 14 where at the upper end of the suction passageway 20 the viscous material is drawn into ligaments (e.g., elongate sting-like pieces of the material) by the passing air steam, which ligaments then explode in that air stream into particles within the size range indicated.

To dispense the relatively low viscosity catalyst for the body putty material described above, the suction passageway 22 in the smaller suction tube 19 can have a diameter of about 0.045 inch or 0.114 centimeter, can be spaced about 0.178 inch or 0.45 centimeter away from the outlet end 13 of the nozzle 11, and has its outlet end aligned with the axis of the second air passageway 15, which second air passageway 15 can have a diameter at its outlet end of about 0.052 inch or 0.132 centimeter.

Also included in the spray assembly 10 is a valve 28 comprising a valve body 29 attached to the spray nozzle 11 by a bayonet coupling to be explained later. The valve body 29 has a socket 30, and has outwardly projecting tube-like portions defining separate inlet and outlet passageways 32 and 33 communicating with the socket 30, with the outlet passageway 33 communicating between the socket 30 and the suction passageway 20. A moveable or rotary member 34 is mounted in the socket 30 in the valve body 29 for rotational movement between open and closed positions through intermediate positions between those open and closed positions. The rotary member 34 has a connectable passageway 36 adapted to connect between the inlet and outlet passageways 32 and 33 in the open and intermediate positions, and to be spaced from the inlet and outlet passageways 32 and 33 in the closed position so that the rotary member 34 blocks communication between the inlet and outlet passageways 32 and 33 in the valve body 29, and to have decreasing portions of the cross sectional areas of the passageways 32, 33, 36 connected at the interface between the valve body 29 and the rotary member 34 during movement of the rotary member 34 through the intermediate positions from the open position toward the closed position.

The spray assembly 10 also includes a reservoir adapter 37 having a through opening 38 that is adapted to engage a reservoir 39 (e.g., a one quart container as illustrated) containing the high viscosity material to be sprayed with the high viscosity material at the through opening 38. The reservoir adapter 37, as illustrated, is adapted to engage a standard 1 and ¾ inch or 4.45 centimeter diameter externally threaded collar 41 that forms an opening for the reservoir or container 39. As is best seen in FIG. 1, the adapter 37 includes a main portion 42 including a first short hollow cylindrical tube 43 co-axially at its center, a radially outwardly projecting flange 44 about midway along the length of the first tube 43 that is adapted to rest on the distal end of the threaded collar 41 and has a radial vent slot 45 that provides a vent for the container 37, a hose bib 46 formed around the periphery of the first tube 43 at one end, and walls defining a socket 47 in the first tube 43 at it's other end. Those walls have L-shaped slots 48 and are adapted to provide half of a bayonet coupling that releasably engages an end portion 50 of a tube on the valve body 29 in which the inlet passageway 32 is located. That end portion 50 has radially outwardly projecting pins 52 adapted to engage surfaces of the walls defining the L-shaped slots 48 in a conventional manner by first sliding the pins 52 axially into axially aligned portions of the slots 48 and then rotating the first tube 43 and the valve body 29 relative to each other to cause the pins 52 to firmly cam into circumferentially extending portions of the slots 48 at which they are retained by a detent between the pins 52 and the walls defining the slots 48. The end portion 50 has a distal end formed with an annular radially outwardly projecting ridge 53 adapted to seal against the inner surface of the socket 47 upon engagement of the pins 52 against the surfaces defining the L-shaped slots 48. A circular metal collar 54 included in the reservoir adapter 37 has an internally threaded cylindrical portion 55 adapted to engage the threads on the flange of the container 39, and a radially inwardly extending portion 56 adapted to bear against and press the flange 44 against the end of that collar 41 when the cylindrical portion 55 is so engaged. The reservoir adapter 47 also includes a hollow cylindrical dip tube 58 adapted to reach to the bottom of the container 39 with which the reservoir adapter 37 is engaged, with one end portion of the dip tube 58 engaged over the hose bib 46 formed around the end of the tube 43. While the reservoir adapter 37 illustrated is preferred for many purposes, the spray assembly 10 could alternatively include any reservoir adapter that serves to provide a supply of the liquid coating material to be sprayed at the valve 28, which adapter could include a hose between the valve 28 and the reservoir.

Figure 2:
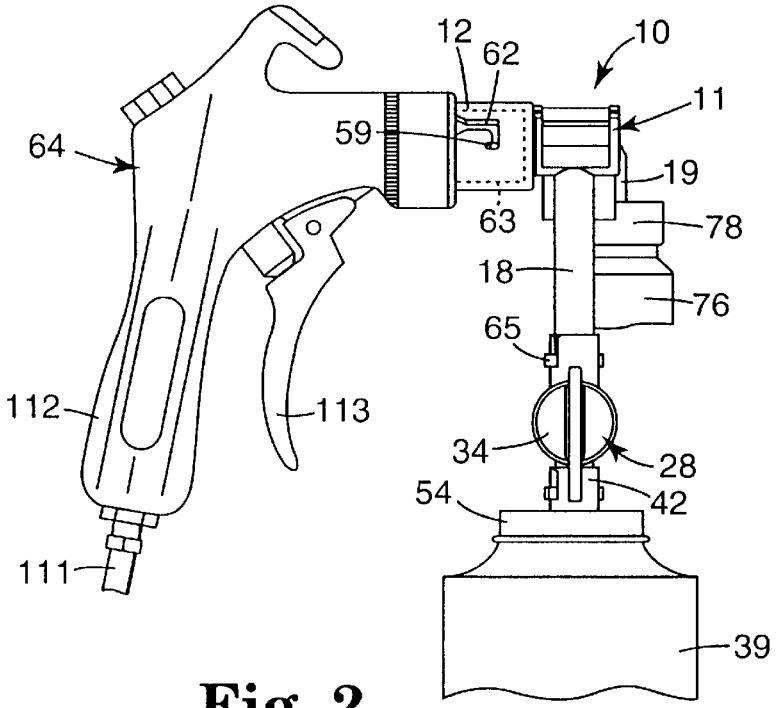
FIG. 2 is a side view of the spray assembly of FIG. 1 attached to the containers and to an air gun.
Figure 3:
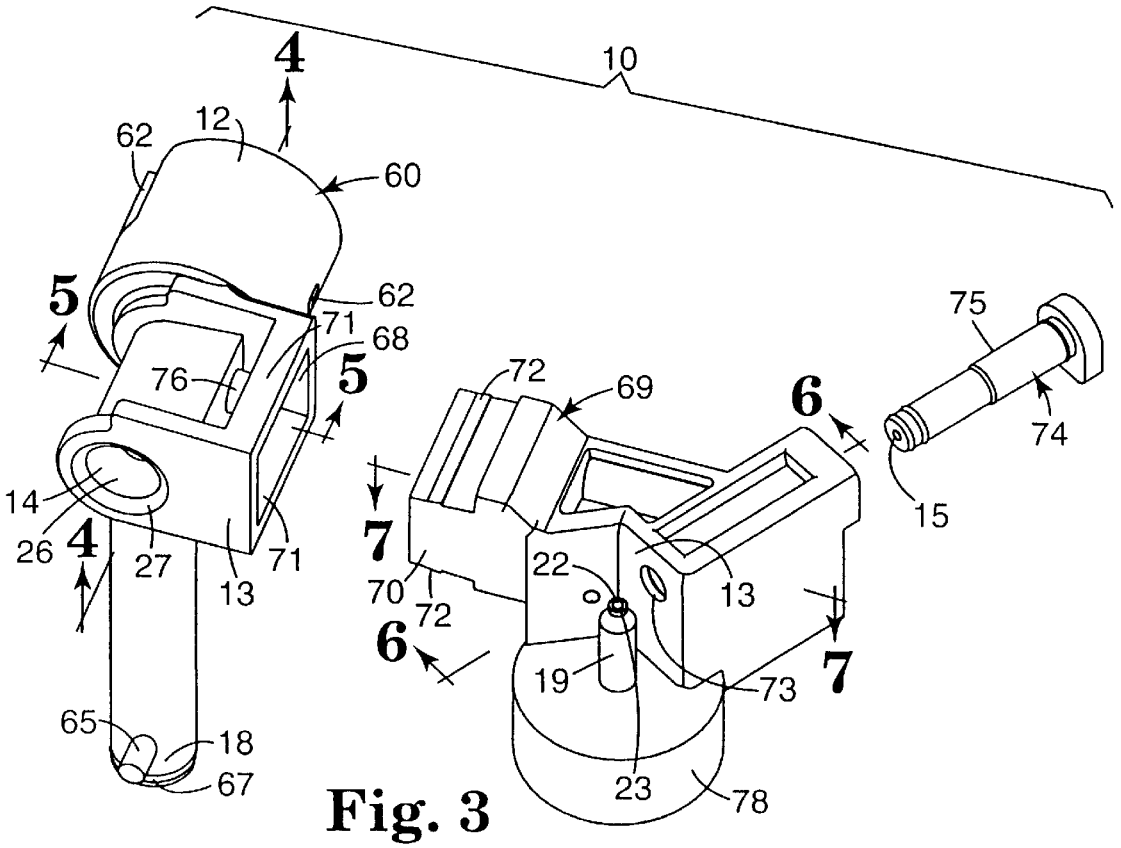
FIG. 3 is an enlarged exploded perspective view of a spray nozzle included in the spray assembly of FIG. 1.
Figure 4:
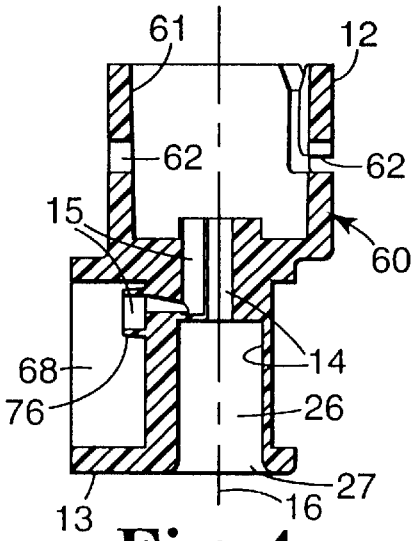
FIG. 4 is a sectional view taken approximately along line 4—4 of FIG. 3.

As is best seen in FIGS. 3 through 8, the spray nozzle 11 is a three part injection molding of a polymeric material (e.g., polypropylene). A first nozzle part 60 provides the entire first air passageway 14 that extends from the inlet end portion 12 which includes a cylindrical wall defining a socket 61 and having L-shaped slots 62 that is adapted to provide half of a bayonet coupling that releasably engages an end portion 63 with radially projecting pins 59 of an air gun 64 (FIG. 2). The first nozzle part 60 also includes the suction tube 18 in which is formed the suction passageway 20. A distal end portion of the suction tube 18 is adapted to be inserted into a socket in the tube like portion 83 of the valve body 29 that defines its outlet opening 33 and has radially outwardly projecting pins 65 adapted to engage surfaces that define opposed L-shaped slots 66 in that tube like portion 83 in a conventional manner to provide a bayonet coupling therebetween, and has an annular radially outwardly projecting ridge 67 at its distal end that is adapted to seal against the inner surface of that socket when the pins 65 are engaged with the surfaces defining the L-shaped slots 66. The first nozzle part 60 has walls defining a generally rectangular socket 68 and also provides a part of the second air passageway 15 that communicates with the bottom of the socket 68 through the center of a frusta conical projection 76. A second nozzle part 69 includes a rectangular projection 70 adapted to be received and to be releasably engaged in the socket 68 by engagement of transverse portions 71 of the first nozzle part 60 on opposite sides of the socket 68 behind ridges 72 on opposite sides of the rectangular projection 70. The second nozzle part 69 also provides a part of the second air passageway 15 that opens through the distal end of the rectangular projection 70 and is adapted to communicate with the part of the second air passageway 15 in the first nozzle part 60 when the rectangular projection 70 is engaged in the socket 68 in that the frusta conical projection 76 on the first nozzle part 60 is then received in air tight engagement in a mating receptacle 77 in the second nozzle part 69. The part of the second air passageway 15 in the second nozzle part 60 communicates with a through opening 73 in the second nozzle part 69. The through opening 73 receives a third nozzle part 74 that has its opposite ends fixed and sealed by a suitable adhesive at the opposite sides of the second nozzle part 69. The third nozzle part 74 provides a third part of the second air passageway 15 including its straight portion and its outlet end. The third nozzle part 74 is slotted through its side 75 to provide an inlet to its part of the second air passageway 15 through that slot that receives air from the part of the second air passageway 15 in the second part 69 of the nozzle 11. The second nozzle part 69 also provides the suction tube 19 together with an internally threaded collar 78 around a portion of the suction tube 19 facing away from and spaced from its upper end that is adapted to receive the threaded neck on a standard 1.1 inch or 2.8 centimeter diameter polymeric container or bottle 76 in which catalyst can be contained. The center of the threaded collar 78 has a socket communicating with the suction passageway 22 through the suction tube 19, in which socket an end portion of a dip tube 79 may be frictionally retained or adhered (FIG. 6), with the dip tube 79 extending into the container 76 engaged with the collar 78 so that catalyst in the container 76 can be drawn through the dip tube 79 into the passageway 22 through the suction tube 19.

Figure 9:
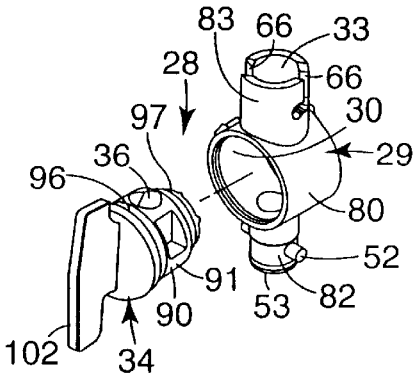
FIG. 9 is an exploded perspective view of a valve included in the spray assembly illustrated in FIG. 1.
Figure 10:
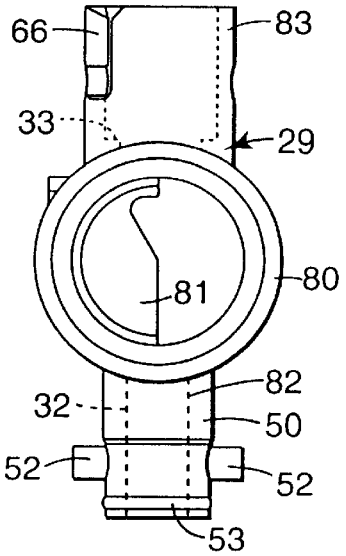
FIG. 10 is an enlarged front view of a valve body included in the valve illustrated in FIG. 9.
Figure 11:
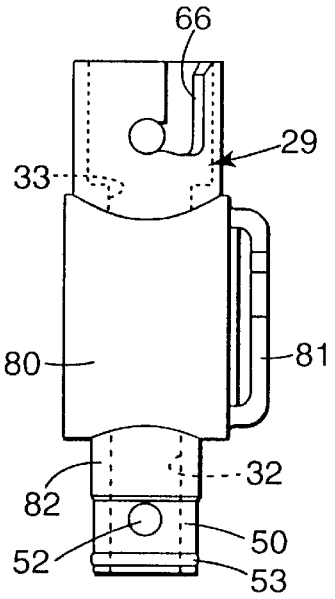
FIG. 11 is an enlarged side view of the valve body illustrated in FIG. 10.
Figure 12:
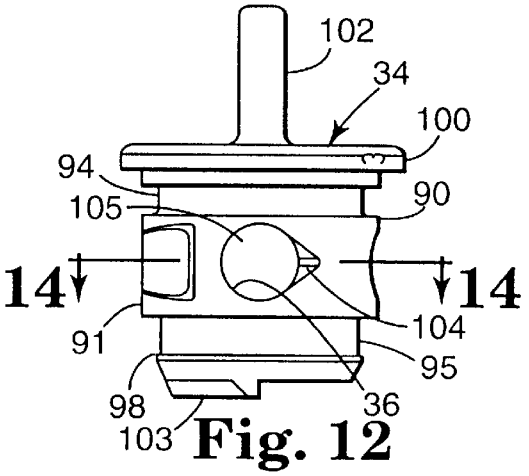
FIG. 12 is an enlarged top view of a movable member included in the valve illustrated in FIG. 9.
Figure 13:
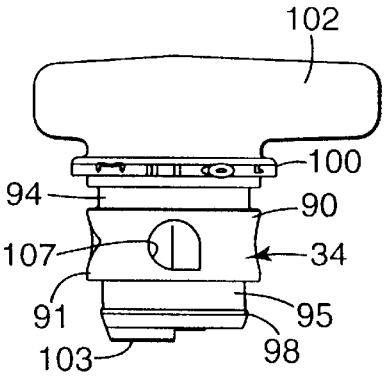
FIG. 13 is an enlarged side view of the movable member illustrated in FIG. 12.
Figure 14:
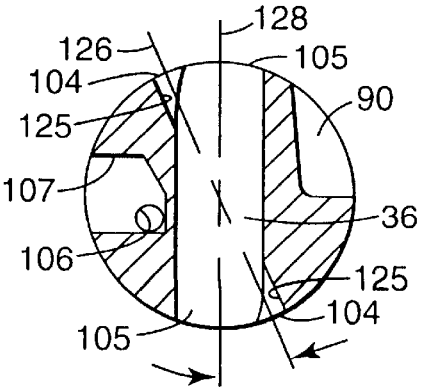
FIG. 14 is a sectional view taken approximately along line 14—14 of FIG. 12.

The valve body 29 (see FIGS. 9, 10 and 11) and the moveable or rotary member 34 (see FIGS. 9, 12, 13, and 14) of the valve 28 are also both injection molded of a polymeric material (e.g., polypropylene) The valve body 29 includes a hollow cylindrical portion 80 defining the socket 30 which is also generally cylindrical, a partial end wall 81 across one end of the socket 30, and the opposite outwardly projecting portions 82 and 83 which define the axially aligned inlet and outlet passageways 32 and 33, respectively. The rotary member 34 includes a generally cylindrical portion 90 including a central part 91 with a cylindrical peripheral surface adapted to fit closely with a portion of the inner surface defining the socket 30 and through which the connectable passageway 36 radially extends. The rotary member 34 has annular grooves 94 and 95 flanking its central part 91 around which O ring seals 96 and 97 extend to provide a seal with the inner surface of the cylindrical portion 80, and a ridge 98 at one end adapted to engage a recess around the surface defining the socket 30 to retain the rotary member 34 in the socket 30. The rotary member 34 also has a radially projecting ridge 100 around its end opposite the ridge 98 that is positioned along one end of the cylindrical portion 80 and a transverse handle portion 102 projecting beyond the cylindrical portion 90 that can be manually engaged to rotate the rotary member 34 with respect to the valve body 29 between its closed and open positions. The rotary member 34 also has radially extending ridges 103 disposed in a V-shaped pattern and projecting from its end opposite the handle 102 that are adapted to abut an edge of the partial end wall 81 and limit rotation of the rotary member 34 to rotation between its open and closed positions.

Figure 15:
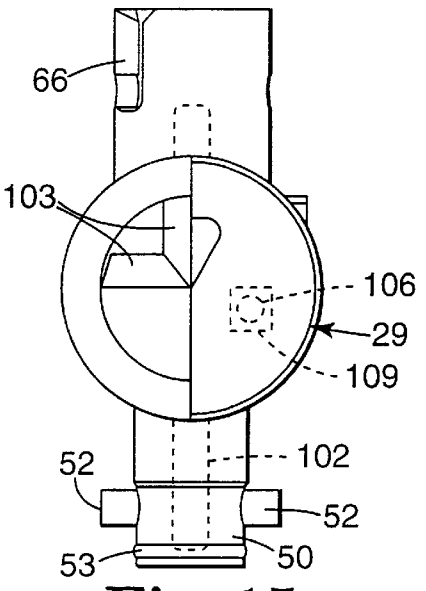
FIG. 15 is an enlarged rear view of the valve illustrated in FIG. 9 when the valve is assembled and the movable member is in an open position.
Figure 16:
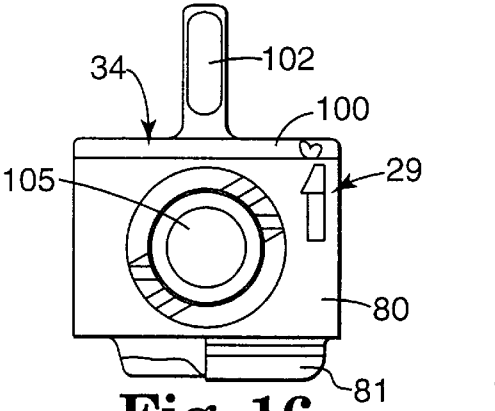
FIG. 16 is a top view of the valve as illustrated in FIG. 15.
Figure 18:
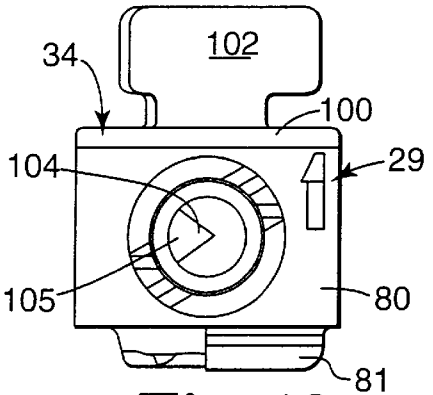
FIG. 18 is a top view of the valve as illustrated in FIG. 17.

At their interfaces between the valve body 29 and the rotary member 34 the inlet and outlet passageways 32 and 33 are circular, and the opposite ends of the connectable passageway 36 (see FIGS. 12 and 14) have non-circular elongated shapes tapered at one end that are adapted to increase the angle of rotation required to rotate the rotary member 34 from its open portion through its intermediate positions to its closed position, and to afford more accurate adjustment of the rotary member to allow small amounts of the material being sprayed to pass through the valve 28 than would be possible if the opposite ends of the connectable passageway 36 had circular shapes of the same diameter as the inlet and outlet passageways 32 and 33. The opposite ends of the connectable passageway 36 have circular portions 105 of the same diameter as the inlet and outlet passageways 32 and 33 which align with the inlet and outlet passageways 32 and 33 when the rotary member 34 is in its open position with respect to the valve body 29 (see FIGS. 15 and 16). The opposite ends of the connectable passageway 36 also have V shaped portions 104 at the ends of V-shaped grooves similar in shape to the pour spout on a pitcher, which V-shaped grooves are on opposite sides at its opposite ends (see FIGS. 12 and 14). As the rotary member 34 is rotated through its intermediate positions toward its closed position first both a portion of its circular portion 105 and its V-shaped portion 104 will be in communication with the circular inlet and outlet passageways 32 and 33 as can be seen in FIG. 18. Subsequently only the V-shaped portions 104 will be in communication with the circular ends of the inlet and outlet passageways 32 and 33, and the areas of the parts of the V-shaped portions in communication will diminish linearly as the rotary member 34 is moved to its closed position. The V-shaped portions 104 thus elongate the openings at the ends of the connectable passageway 36 to extend the amount of rotation needed to move the rotary member 34 to its closed position, and decrease the rate at which the ends of the connectable passageway 36 move out of alignment with the ends of the inlet and outlet passageways 32 and 33 compared to the use of a connectable passageway 36 with circular ends of the same diameter as the ends of the inlet and outlet passageways 32 and 33. These V-shaped grooves 104 thus facilitate fine adjustment by the craftsman of the amount of material moving into the nozzle 11, resulting in a very thin (e.g., 0.002 inch or 0.005 centimeter thick) pin hole free coating of the material on a surface being sprayed. While the V-shaped portions 104 illustrated are preferred because of their simplicity and ease of formation, other shapes could be used to replace the V-shaped portions 104, such a W shape or a half oval shape with a long width to height ratio. Also, alternatively the opposite ends of the connectable passageway 36 could be circular and the inlet and outlet passageways 32 and 33 could have non-circular elongated shapes tapered at one end at their interfaces with the rotary member 34 that are adapted to increase the angle of rotation required to rotate the rotary member 34 from its open portion through its intermediate positions to its closed position, and which afford more accurate adjustment of the rotary member 34 to allow small amounts of the material being sprayed to pass through the valve 28 than would be possible if the inlet and outlet passageways 32 and 33 had circular shapes of the same diameter as the connectable passageway 36 at those interfaces.

As an example, the cylindrical portion 90 of the rotary member 34 can have a diameter of 0.760 inch or 1.930 centimeters, the inlet and outlet passageways 32 and 33 both can have diameters of 0.250 inch or 0.635 centimeter, and the connectable passageway 36 can have, at each end, a circular portion 105 with a 0.250 inch or 0.635 centimeter diameter and a V-shaped portion 104 with an apex angle of 67.9 degrees that projects beyond the circular portion 105. The V-shaped portion 104 can be at the end of a V-shaped groove, the apex or bottom 125 of which (see FIG. 7) had a 0.015 inch or 0.038 centimeter radius and is parallel to and spaced 0.050 inch or 0.127 centimeter away from an imaginary line 126, which imaginary line 126 passes through the axis of the rotary member 34 and is disposed at an angle 117 of 24 degrees with respect to the centerline or axis 128 of the connectable passageway 36.

Figure 17:
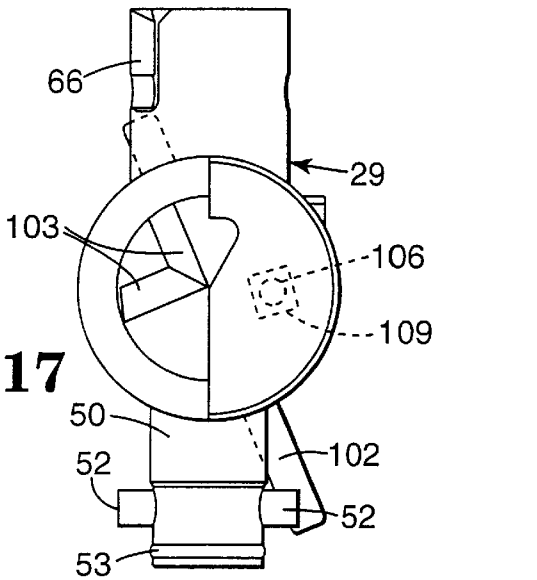
FIG. 17 is an enlarged rear view of the valve illustrated in FIG. 9 when the valve is assembled and the movable member is in one of its intermediate positions.
Figure 19:
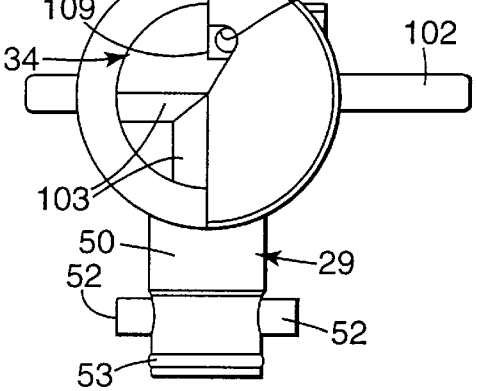
FIG. 19 is an enlarged rear view of the valve illustrated in FIG. 9 when the valve is assembled and the movable member is in a closed position.
Figure 20:
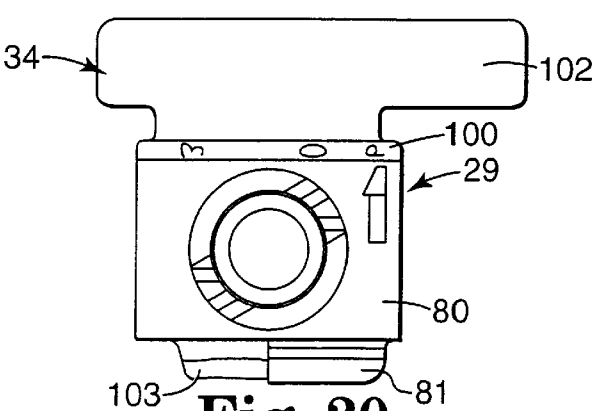
FIG. 20 is a top view of the valve as illustrated in FIG. 19.

The valve 28 includes means for allowing air to be drawn into the nozzle 11 through the outlet and suction passageways 33 and 20 to purge them and the first air passageway of the high viscosity material after the rotary member 34 is moved to its closed position. The rotary member 34 has an air inlet passageway (see FIG. 14) having an inlet opening 106 through the end surface of the rotary member 34 opposite the handle portion 102, and an outlet opening 107 through the central part 91 of the cylindrical portion 90 positioned to communicate with the outlet passageway 33 in the valve body 29 in the closed position of the rotary member 34 (see FIGS. 19 and 20), and to be spaced from the outlet passageway 33 in the valve body 29 in the intermediate and open positions of the rotary member 34. A projecting annular ring 109 around the inlet opening 106 to the air inlet passageway is positioned along the planar inner surface of the partial end wall 81 on the valve body 29 to seal it closed when the rotary member 34 is in its open or intermediate positions (see FIGS. 15 and 17), whereas that inlet opening 106 moves into alignment with an opening along the edge of the partial end wall 81 when the rotary member 34 moves to its closed position (see FIG. 19) so that air can then be drawn into the outlet passageway 33, suction passageway 16, and the nozzle 11 to purge it of the high viscosity material.

To operate the spray assembly 10, the inlet end portion 12 is coupled to the air supply gun 64 (e.g., the air gun sold under the trade designation "3M No Cleanup Applicator gun", "Part Number 051135-08801" by Minnesota Mining and Manufacturing Company, St. Paul, Minn.), which air supply gun 64 is attached by an air hose 111 to a source of air under pressure (see FIG. 2) and is manually manipulated by a handle 112 and manually activated by pulling a trigger 113 to propel air under pressure through the passageways 14 and 15 in the spray nozzle 11. Such movement of the air causes suction through the tubes 18 and 19 to draw (when the valve 28 is open) viscous material through the tube 18 and to draw catalyst through the tube 19 into those air streams, which air streams then intersect at the position 25 outside of the nozzle 11 to mix them together just before they impact a surface onto which they are being sprayed. If the valve 28 is partially closed, less viscous material will be sprayed, however, the amount of catalyst being mixed with it will remain constant. When the viscous material is body putty, the higher than needed ratio of catalyst in the body putty when the amount of body putty being sprayed is thus reduced does not adversely effect the body putty except that it accelerates its rate of cure. When the desired amount of viscous material has been sprayed, the valve 28 can be closed, whereupon the valve 28 will cause air to be sucked into the nozzle 11 through the opening 106 in the valve 28 to clean the viscous material from the nozzle 11.

The present invention has now been described with reference to one embodiment and several modifications thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

What is claimed is:

1. A spray assembly adapted for spraying high viscosity un-cured resin while combining a catalyst with the resin that will cause the resin to cure, said spray assembly comprising:

a spray nozzle having an inlet end portion adapted to be coupled to a source of air under pressure, an outlet end having first and second portions, said spray nozzle having inner surfaces defining a first through air passageway between said inlet end portion and said first portion of said outlet end, said first through air passageway having a straight central axis adjacent said first portion of said outlet end, a first suction tube having upper and lower ends and a first through suction passageway between said upper and lower ends, the upper end of said first suction tube being positioned within said first through air passageway with a portion of the first suction passageway at the upper end of said first suction tube disposed at generally a right angle with respect to the straight central axis of said first through air passageway so that an air stream propelled through said first through air passageway from said inlet end portion will pass over the upper end of said first suction tube and can draw the un-cured resin through said first suction passageway into the air stream, one of said inner surfaces defining said first through air passageway being generally cylindrical and having a generally uniform diametrical dimension for the majority of the distance from said outlet end to a side of said first suction tube opposite said outlet end, and the first through opening in said first suction tube having a cross sectional area that is over 50 percent of the cross sectional area of said generally cylindrical portion of said first through passageway, said inner surfaces of said spray nozzle also defining a second through air passageway between said inlet end portion and said second portion of said outlet end, said second air passageway having a straight central axis adjacent said second portion of said outlet end, a second suction tube having upper and lower ends and a second through suction passageway between said upper and lower ends, the upper end of said second suction tube being positioned with a portion of the second suction passageway at the upper end of said second suction tube disposed at generally a right angle with respect to the central axis of said second passageway so that an air stream propelled through said second passageway from said inlet end portion will pass over the upper end of said second suction tube and can draw the catalyst material through said second suction passageway into the air stream propelled through said second through air passageway, said straight central axes of said first and second air passageways being disposed to cause air streams propelled through said first and second air passageways to intersect at a position spaced from said nozzle to mix at that position the un-cured resin and catalyst materials drawn into said air streams through said first and second suction passageways;

means for providing the un-cured resin at the first through suction passageway of said first suction tube; and means for providing the catalyst at the second through suction passageway of said second suction tube.

2. A spray assembly according to claim 1 wherein the upper end of said first suction tube projects between about 15 to 27 percent of the distance across the diameter of said generally cylindrical portion of said first through passageway.

3. A spray assembly according to claim 1 wherein the un-cured resin adapted to be sprayed by the spray assembly, when mixed with the catalyst, will form body putty that can be sprayed onto a surface, and wherein the cross sectional area of the first through opening in said first suction tube is about 0.317 square centimeter, the cross sectional area of said generally cylindrical portion of said first through passageway is about 0.60 square centimeter, and the upper end of said first suction tube is spaced in the range of about 0.2 to 0.3 centimeter from the straight central axis of said first air passageway.

4. A spray assembly according to claim 1 wherein said upper end of said second suction tube is outside of said second through air passageway and spaced from said second portion of said outlet end.

5. A spray assembly according to claim 1 wherein the distance from the center of the upper end of the first suction tube to the first portion of the outlet end is in the range of about 1 to 1.27 centimeters, and the distance from the upper end of the first suction tube to the center of the cylindrical inner surface portion is in the range of about 0.2 to 0.3 cm with the first suction tube projecting between about 15 to 27 percent of the distance across the diameter of the cylindrical inner surface portion.

6. A spray assembly according to claim 1 wherein said straight central axes of said first and second air passageways are disposed at an included angle in the range of about 30 to 45 degrees to cause air streams propelled through said first and second air passageways to intersect at a position spaced from said nozzle.

7. A spray assembly according to claim 1 wherein said spray nozzle is a three part molding of polymeric material comprising a first nozzle part including said inlet end portion, said first air passageway, said first suction tube for the first air passageway, a first part of the second air passageway, said first nozzle part having a socket with a bottom with which said first part of the second air passageway communicates; a second nozzle part including a projection received and releasably engaged in the socket, and having a through opening, said second nozzle part having a second part of the second air passageway that opens through the distal end of the projection and is in communication with the first part of the second air passageway in the first nozzle part and communicates with said through opening; and a third nozzle part received in said through opening and having opposite ends fixed and sealed at the opposite sides of said second nozzle part, the third nozzle part providing a third part of the second air passageway including said straight portion and said second portion of the outlet end, the third nozzle part having an inlet to said third part of the second air passageway that receives air from the second part of the second air passageway in the second part of the nozzle.

8. A spray assembly according to claim 1 wherein said spray assembly further includes a valve coupled to the lower end of said first suction tube, said valve comprising:

a valve body attached to said spray nozzle, having a socket, and having separate inlet and outlet passageways having spaced ends communicating with said socket with said outlet passageway communicating between said socket and the first suction passageway in said first suction tube, a moveable member mounted in the socket in said valve body for movement between open and closed positions and through intermediate positions between said open and closed positions, said moveable member having a connectable passageway having opposite ends adapted to connect between the spaced ends of said inlet and outlet passageways with pairs of said opposite ends and said spaced ends in communication in said open and intermediate positions, to be spaced from at least one of the spaced ends of said inlet and outlet passageways in said closed position so that in said closed position said moveable member blocks communication between said inlet and outlet passageways in said valve body, and adapted to have decreasing portions of said pairs of said opposite ends and said spaced ends in communication during movement of said moveable member through said intermediate positions from said open position toward said closed position, said moveable member having a through air inlet passageway having an inlet opening through the surface of said moveable member that is open to the atmosphere when said moveable member is in said closed position, and an outlet opening positioned to communicate with said outlet passageway in said valve body in the closed position of said moveable member so that air will be drawn into said outlet passageway, said outlet opening being spaced from said outlet passageway in said valve body in the intermediate and open positions of said moveable member.

9. A spray assembly adapted for spraying un-cured resin while combining a catalyst with the resin that will cause the resin to cure, said spray assembly comprising:

a spray nozzle having an inlet end portion adapted to be coupled to a source of air under pressure, an outlet end having first and second portions, said spray nozzle having inner surfaces defining a first through air passageway between said inlet end portion and said first portion of said outlet end, said first through air passageway having a straight central axis adjacent said first portion of said outlet end, a first suction tube having upper and lower ends and a first through suction passageway between said upper and lower ends, the upper end of said first suction tube being positioned within said first through air passageway with a portion of the first suction passageway at the upper end of said first suction tube disposed at generally a right angle with respect to the straight central axis of said first through air passageway so that an air stream propelled through said first through air passageway from said inlet end portion will pass over the upper end of said first suction tube and can draw the un-cured resin through said first suction passageway into the air stream, said inner surfaces of said spray nozzle also defining a second through air passageway between said inlet end portion and said second portion of said outlet end, said second air passageway having a straight central axis adjacent said second portion of said outlet end, a second suction tube having upper and lower ends and a second through suction passageway between said upper and lower ends, the upper end of said second suction tube being positioned with a portion of the second suction passageway at the upper end of said second suction tube disposed at generally a right angle with respect to the central axis of said second passageway so that an air stream propelled through said second passageway from said inlet end portion will pass over the upper end of said second suction tube and can draw said catalyst material through said second suction passageway into the air stream propelled through said second through air passageway, said straight central axes of said first and second air passageways being disposed to cause air streams propelled through said first and second air passageways to intersect at a position spaced from said nozzle to mix at that position the un-cured resin and catalyst materials drawn into said air streams through said first and second suction passageways;

a valve comprising a valve body attached to said spray nozzle, having a socket, and having separate inlet and outlet passageways having spaced ends communicating with said socket with said outlet passageway communicating between said socket and the suction passageway in said first suction tube, a moveable member mounted in the socket in said valve body for movement between open and closed positions and through intermediate positions between said open and closed positions, said moveable member having a connectable passageway having opposite ends adapted to connect between the spaced ends of said inlet and outlet passageways with pairs of said opposite ends and said spaced ends in communication in said open and intermediate positions, to be spaced from at least one of the spaced ends of said inlet and outlet passageways in said closed position so that in said closed position said moveable member blocks communication between said inlet and outlet passageways in said valve body, and adapted to have decreasing portions of said pairs of said opposite ends and said spaced ends in communication during movement of said moveable member through said intermediate positions from said open position toward said closed position, said moveable member having a through air inlet passageway having an inlet opening through the surface of said moveable member that is open to the atmosphere when said moveable member is in said closed position, and an outlet opening positioned to communicate with said outlet passageway in said valve body in the closed position of said moveable member so that air will be drawn into said outlet passageway, said outlet opening being spaced from said outlet passageway in said valve body in the intermediate and open positions of said moveable member;

means for providing the un-cured resin at the inlet passageway in the valve body; and means for providing the catalyst at the through suction passageway of said second suction tube.

10. A spray assembly according to claim 9 wherein one of said inner surfaces defining said first through air passageway is generally cylindrical and has a generally uniform diametrical dimension for the majority of the distance from said outlet end to a side of said first suction tube opposite said outlet end, and the first through opening in said first suction tube has a cross sectional area that is over about 50 percent of the cross sectional area of said generally cylindrical portion of said first through passageway.

11. A spray assembly according to claim 9 wherein cross sectional area of the through opening in said first suction tube is generally over 50 percent of the cross sectional area of said generally cylindrical portion of said first through passageway and the upper end of said first suction tube projects between about 15 to 27 percent of the distance across the diameter of said generally cylindrical portion of said first through passageway.

12. A spray assembly according to claim 9 wherein the un-cured resin adapted to be sprayed by the spray assembly, when mixed with the catalyst, will form body putty that can be sprayed onto a surface, and wherein the cross sectional area of the first through opening in said first suction tube is about 0.4 square centimeter, the cross sectional area of said generally cylindrical portion of said first through passageway is about 0.317 square centimeter, and the upper end of said first suction tube is spaced in the range of about 0.2 to 0.3 centimeter from the straight central axis of said first air passageway.

13. A spray assembly according to claim 9 wherein said upper end of said second suction tube is outside of said second through air passageway and spaced from said second portion of said outlet end.

14. A spray assembly according to claim 9 wherein said straight central axes of said first and second air passageways are disposed at an included angle in the range of about 30 to 45 degrees to cause air streams propelled through said first and second air passageways to intersect at a position spaced from said nozzle.

15. A spray assembly according to claim 9 wherein the surfaces of said spray nozzle defining said first through air passageway can shape the air stream passing through said outlet end to provide a spray width of less than about 2.5 inches wide at a distance of about 8 inches from said outlet end.

16. A spray assembly according to claim 9 wherein in said valve one of said opposite ends or said spaced ends in each of said pairs of said opposite ends and said spaced ends has a shape adapted to increase the amount of movement required to move the movable member from its open position through its intermediate positions to its closed position and to afford more accurate adjustment of the movable member to allow small amounts of the un-cured resin to pass through the valve than would be possible if those pairs of ends both had circular shapes of the same diameter.

17. A spray assembly according to claim 16 wherein said shape of said one of said opposite ends or said spaced ends comprises a circular portion and a generally V-shaped portion projecting at one side of said circular portion.

18. A spray assembly according to claim 9 wherein one of said inner surfaces defining said first through air passageway is generally cylindrical and has a generally uniform diametrical dimension for the majority of the distance from said outlet end to a side of said first suction tube opposite said outlet end, and the distance from the center of the upper end of the first suction tube to the first portion of the outlet end is in the range of about 1 to 1.27 centimeters, and the distance from the upper end of the first suction tube to the center of the cylindrical inner surface portion is in the range of about 0.2 to 0.3 cm with the first suction tube projecting between about 15 to 27 percent of the distance across the diameter of the cylindrical inner surface portion.

19. A spray assembly according to claim 9 wherein said valve assembly includes means for sealing the inlet opening of said air inlet passageway against a surface of said valve body in said intermediate and open positions of said moveable member.

20. A spray assembly adapted for spraying un-cured resin while combining a catalyst with the resin that will cause the resin to cure, said spray assembly comprising a spray nozzle having an inlet end portion adapted to be coupled to a source of air under pressure, an outlet end having first and second portions, said spray nozzle having inner surfaces defining a first through air passageway between said inlet end portion and said first portion of said outlet end, said first through air passageway having a straight central axis adjacent said first portion of said outlet end, a first suction tube having upper and lower ends and a first through suction passageway between said upper and lower ends, the upper end of said first suction tube being positioned within said first through air passageway with a portion of the first suction passageway at the upper end of said first suction tube disposed at generally a right angle with respect to the straight central axis of said first through air passageway so that an air stream propelled through said first through air passageway from said inlet end portion will pass over the upper end of said first suction tube and can draw the un-cured resin through said first suction passageway into the air stream, said inner surfaces of said spray nozzle also defining a second through air passageway between said inlet end portion and said second portion of said outlet end, said second air passageway having a straight central axis adjacent said second portion of said outlet end, a second suction tube having upper and lower ends and a second through suction passageway between said upper and lower ends, the upper end of said second suction tube being positioned with a portion of the second suction passageway at the upper end of said second suction tube disposed at generally a right angle with respect to the central axis of said second passageway so that an air stream propelled through said second passageway from said inlet end portion will pass over the upper end of said second suction tube and can draw said catalyst material through said second suction tube passageway into the air stream propelled through said second through air passageway, said straight central axes of said first and second air passageways being disposed to cause air streams propelled through said first and second air passageways to intersect at a position spaced from said nozzle to mix at that position the un-cured resin and catalyst materials drawn into said air streams through said first and second suction passageways; said spray nozzle being a three part molding of polymeric material comprising a first nozzle part including said inlet end portion, said first air passageway, said first suction tube for the first air passageway, a first part of the second air passageway, said first nozzle part having a socket with a bottom with which said first part of the second air passageway communicates; a second nozzle part including a projection received and releasably engaged in the socket, and having a through opening, said second nozzle part having a second part of the second air passageway that opens through the distal end of the projection and is in communication with the first part of the second air passageway in the first nozzle part and communicates with said through opening; and a third nozzle part received in said through opening and having opposite ends fixed and sealed at the opposite sides of said second nozzle part, the third nozzle part providing a third part of the second air passageway including said straight portion and said second portion of the outlet end, the third nozzle part having an inlet to said third part of the second air passageway that receives air from the second part of the second air passageway in the second part of the nozzle.

* * * * *